United States Patent [19]

Gibson

[11] 4,420,508

[45] * Dec. 13, 1983

[54] POWDER COATING THE INTERIOR OF PIPE

[76] Inventor: Jack E. Gibson, 4905 Pepperidge Pl., Odessa, Tex. 79762

[ * ] Notice: The portion of the term of this patent subsequent to Jan. 6, 1998 has been disclaimed.

[21] Appl. No.: 237,380

[22] Filed: Feb. 23, 1981

Related U.S. Application Data

[63] Continuation-in-part of Ser. No. 118,660, Feb. 4, 1980.

[51] Int. Cl.[3] ..... B05D 1/06; B05D 7/22

[52] U.S. Cl. ..... 427/183; 427/181; 118/308; 118/DIG. 10; 222/80; 222/82; 222/325

[58] Field of Search ..... 222/325, 82, 80; 427/181, 182, 183; 118/308, DIG. 10

[56] References Cited

U.S. PATENT DOCUMENTS

| | | | |
|---|---|---|---|
| 3,199,923 | 8/1965 | Brooks | 118/DIG. 5 |
| 3,207,618 | 9/1965 | De Hart | 427/183 X |
| 3,814,616 | 6/1974 | Kondo et al. | 427/183 |
| 3,974,939 | 8/1976 | Melton et al. | 222/325 X |
| 4,089,998 | 5/1978 | Gibson | 427/183 X |
| 4,165,022 | 8/1979 | Bentley et al. | 222/325 |
| 4,243,699 | 1/1981 | Gibson | 427/183 |
| 4,256,241 | 3/1981 | Mesic | 222/325 |

FOREIGN PATENT DOCUMENTS

| | | |
|---|---|---|
| 295268 | 3/1966 | Australia . |

*Primary Examiner*—Shrive P. Beck

*Attorney, Agent, or Firm*—Marcus L. Bates

[57] ABSTRACT

Method and apparatus by which the interior of a pipe is coated with a uniform thickness of plastic. A source of heat-meltable plastic material in particular form is connected at a location upstream of the inlet end of the pipe, while the opposed end of the pipe is made attachable to a reduced pressure. A source of compressible fluid is also connected at a location upstream of the inlet end of the pipe. The pipe is preheated and then rotated axially while a charge of powdered plastic is forced through the pipe by the compressible fluid. The powdered plastic which flows through the pipe is a finite pocket of the finely divided plastic, which is smaller in volume respective to the volume of the pipe being coated.

13 Claims, 15 Drawing Figures

POWDER COATING THE INTERIOR OF PIPE

RELATED PATENTS

This patent application is a continuation in part of patent application Ser. No. 118,660 filed Feb. 4, 1980; which is a refile or substitution of patent application Ser. No. 951,642 filed Oct. 16, 1978, now abandoned; which is co-pending with patent application Ser. No. 862,261 filed Dec. 20, 1977, now U.S. Pat. No. 4,243,699 issued Jan. 6, 1981.

BACKGROUND OF THE INVENTION

The above cited patent applications and patents, along with the prior art cited therein, is referred to for further background of this invention.

In Applicant's prior patents, there is disclosed method and apparatus for uniformly coating the interior of pipe by forming a pocket of powered plastic, and pushing the pocket through the pipe. The pocket is of a density and length to cause the powdered plastic material to melt to the interior wall surface of the pipe as the pocket is pushed from the inlet to the outlet of the pipe. The powder contacting the pipe wall is melted as the pocket passes through the pipe interior. The more dense the pocket and the slower the pocket moves through the pipe, the thicker the plastic coating which is fused to the interior of the pipe will be. Accordingly, Applicant has heretofore discovered the phenomena that a uniform coating of synthetic plastic resin can be applied to the interior wall surface of a heated pipe by controlling the density and contact time between the wall surface and the moving pocket of plastic, as the pocket makes a single trip through the pipe.

In carrying out the above method, it is advantageous to provide a dense pocket of powdered plastic at the inlet of the pipe. The pocket should be slightly in excess of the amount of plastic required to coat the entire peripheral wall surface of the pipe in a single pass therethrough. It would therefore be desirable to measure the precise amount of powder required to coat the pipe interior so that a minimum amount of residual powdered plastic emerges from the outlet end of the coated pipe. Moreover, it would be advantageous to be able to rapidly form a more dense pocket of precisely measured powdered plastic material, and to force the powdered material to move through the pipe interior in a minimum length of time so that the production rate of plastic coating the pipe can be held at some satisfactory elevated level of operation.

Method and apparatus for achieving the above is the subject of this invention.

SUMMARY OF THE INVENTION

Method and apparatus for coating the interior of an elongated hollow member by flowing powdered, synthetic, polymeric material through a preheated pipe in such a manner that the powder forms a pocket which is forced through the pipe, with the powder immediately adjacent the pipe wall being melted to form a continuous uniform coating. The powdered charge is premeasured to provide the precise amount of powder required to coat the interior of the pipe and to provide s small residue.

The measured charge of powder which subsequently forms the pocket is placed within an enclosure upstream of the preheated pipe. The enclosure is provided with an outlet which is connected to the pipe interior, and the pipe is rotated at a velocity which causes any subsequent applied plastic to be uniformly distributed about the interior thereof.

In one form of the invention, the powdered plastic is measured and placed into individual containers, thereby providing a plurality of measured powdered plastic charges. The filled containers are individually metered into a powder charging apparatus. One end of the apparatus is connected to or communicated with the preheated rotating pipe, while the other end of the apparatus is connected to or communicated with a source of compressed air. The compressed air flows through the container, carrying the charge of powdered plastic into the rotating preheated pipe, thereby forming a dense pocket of plastic which travels from the inlet to the outlet end of the pipe.

In another form of the invention, the individual charges are conveyed from a fluidized bed into a weighing station where the precise amount of the individual charge is accumulated, and subsequently transported into a coating chamber. The isolated charge is then translocated along a pressure gradient from the coating chamber, into the pipe, thereby forming a pocket which is forced to travel through a pipe while most of the powdered plastic is fused to the pipe wall.

In still another embodiment of the invention, a fluidized bed is provided in the lower end of the vessel, thereby leaving an air chamber at the upper end of the vessel. The vessel is placed under pressure which is above ambient. A flow line is connected to the lower part of the vessel, and communicates the fluidized bed with the inlet of a pipe to be coated. A second conduit is connected to the air chamber at the upper end of the vessel and connects the air chamber with the inlet end of the pipe to be coated. Valve means placed in each conduit enables a charge of plastic to flow into the first conduit, and thereafter the second valve means is opened to provide a pressure gradient which pushes the charge through the pipe.

Accordingly, a primary object of the present invention is the provision of both method and apparatus for applying a continuous coating of plastic to the interior of a pipe.

Another object of the invention is to provide a pipe coating process wherein a finite pocket of particulated plastic material is located upstream of a heated rotating pipe, and a flow of compressible gases upstream of the pocket causes a pocket of gas-entrained particles to flow down through the heated pipe as the particles adhere to the interior wall where they are melted, and subsequently forms a continuous film about the entire inner peripheral wall surface of the pipe.

A further object of this invention is to disclose and provide a pipe coating process wherein a preheated spinning pipe has an outlet end thereof connected to a relatively low pressure source, and the inlet end connected to a relatively high pressure source of compressible gas. A charge of powdered plastic is placed upstream of the pipe within a closed container. The container is placed downstream of the high pressure source. The flow of compressed gases translocates the plastic particles from the container so that a flow of air-entrained plastic particles is produced through the pipe as a pocket of plastic particles.

A still further object of this invention is to provide a method for powder coating hollow, elongated members with heat meltable plastic material, comprising; providing a flow of compressible fluid through the pipe, and placing a pocket of gas-entrained plastic particles downstream of the flowing compressible fluid; and applying a low pressure area at the outlet end of the pipe during the time interval that the plastic is flowing thereinto, and continuing the flow of compressed gases after a residue of the plastic particles emerge therefrom.

Another and still further object of this invention is the provision of apparatus which includes electrical circuitry by which a rotating heated pipe has a mass flow of compressed gases established therethrough, and a pocket of gas-entrained heat fusable plastic particles is caused to flow in series relationship with the compressed gas flow, to thereby enable the particles to form a dense pocket of plastic and contact and adhere to the sidewall of the pipe.

These and other objects and advantages of the invention will become readily apparent to those skilled in the art upon reading the following detailed description and claims and by referring to the accompanying drawings.

The above objects are attained in accordance with the present invention by the provision of method and apparatus fabricated in a manner substantially as described in the above abstract and summary.

DETAILED DESCRIPTION OF THE PREFERRED EMBODIMENTS

Throughout this disclosure the term "pipe" is intended to mean a joint of tubular goods having a relatively smooth interior surface to which there can be fused a heat meltable plastic material. The term "powdered plastic" is intended to mean a heat meltable material which can be bonded to the interior smooth surface of a joint of pipe, as exemplified by the following material: Corvel 501 powder which is available from The Polymer Company, Reading, Pa.

Figure 1:
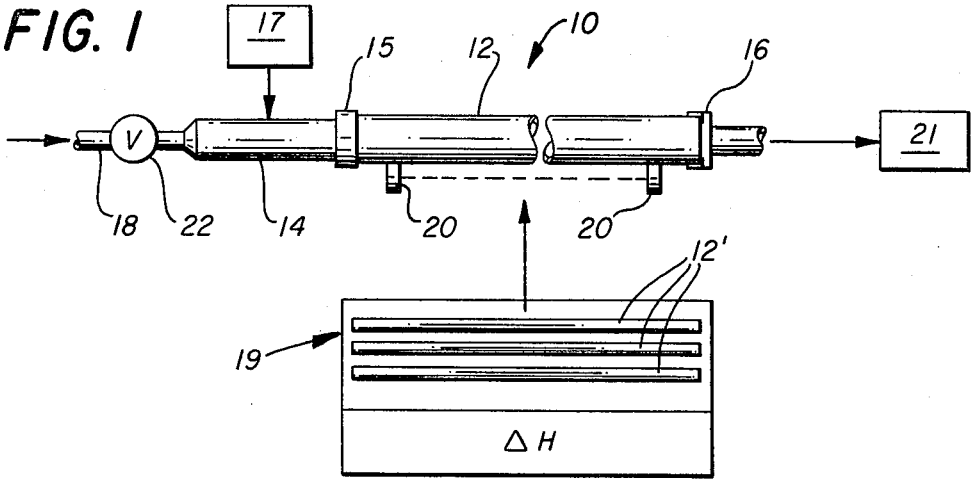
FIG. 1 is a part schematical, part diagrammatical illustration of a process which is carried out in accordance with the present invention.

In FIG. 1 of the drawings, there is set forth apparatus 10, made in accordance with the present invention, and by which the method of the present invention of powder coating pipe can be carried out. The apparatus 10 is adapted to powder coat a preheated pipe 12 having a clean, smooth interior. Powder charging apparatus 14 is communicated or connected to a head 15. The head removably engages the inlet end of the preheated, rotating pipe. An outlet adapter 16 is removably attached to the outlet end of the pipe.

A measured, powdered, charge is stored at 17 and is transferred into the powder charging apparatus 14 where the charge is forced through the pipe during the powder coating operation.

A source of pneumatic pressure 18 is connected through the illustrated valve to the powdered charging apparatus. A preheat oven 19 elevates the temperature of a multiplicity of joints of pipe 12' to a temperature greater than the fusion temperature of the plastic powder stored at 17. One of the preheated joints of pipe 12 is rotatably supported by a plurality of wheels 20. Residual plastic exiting the pipe is collected at 21. Valve 22 controls the flow of compressed air from pressure source 18.

Figure 2:
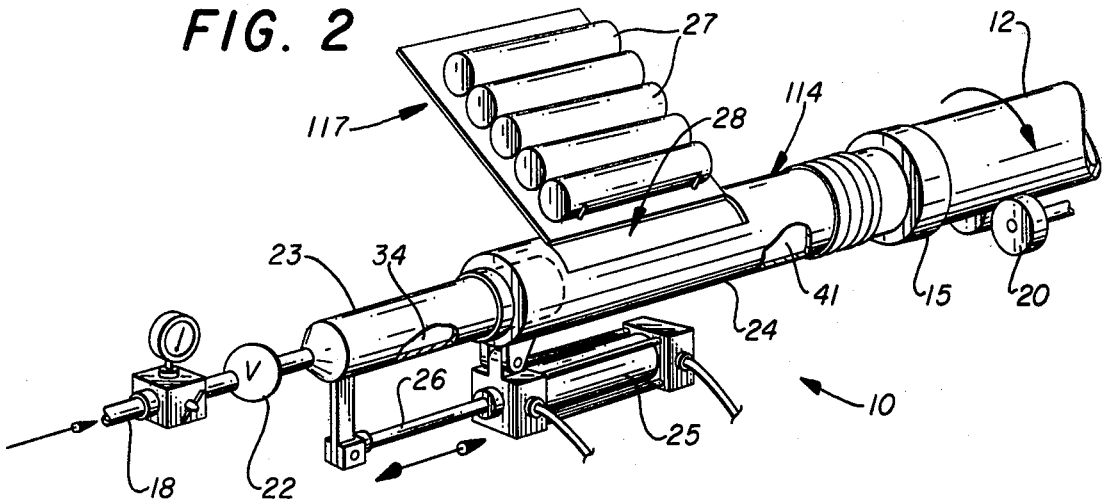
FIG. 2 is a fragmented, perspective view which sets forth the details of one embodiment of the present invention.

FIG. 2 sets forth the details of one embodiment of the present invention. In FIG. 2, the pocket forming apparatus 114 includes plunger 23 reciprocatingly received within a cylindrical chamber 24. Actuating cylinder 25 reciprocates a piston rod 26 which is connected to the plunger for reciprocating the plunger respective to the cylinder 24.

A plurality of individual packages of measured plastic powder 27 is stored at 117 and is sequentially fed into a powder charging window 28 formed within cylinder 24.

Figure 3:
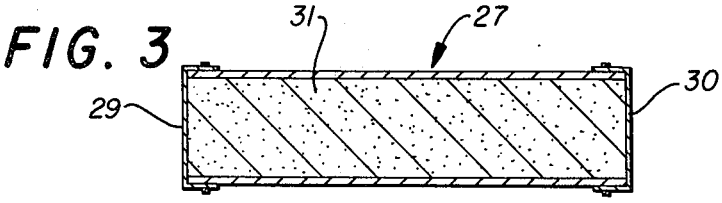
FIG. 3 is an enlarged, cross-sectional view of part of the apparatus disclosed in FIG. 2.
Figure 4:
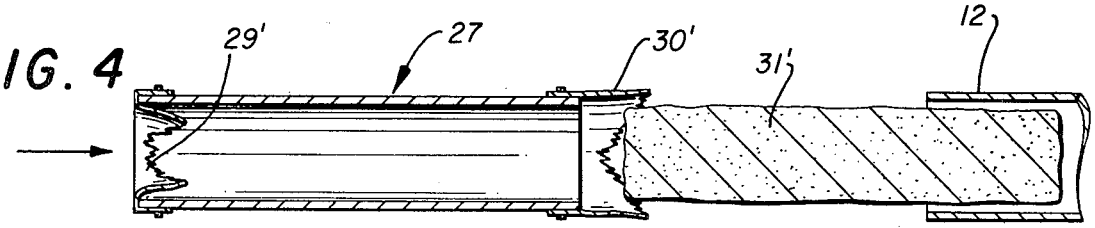
FIG. 4 is a fragmented, part diagrammatical illustration, which dynamically sets forth part of the operation of the apparatus disclosed in FIG. 2.

As seen in FIGS. 3 and 4, the packages 27 are in the form of a cartridge, preferably cylindrical in form, and having destructable opposed ends 29 and 30. A measured powder charge 31 is isolated within the container 27.

In FIG. 4, air pressure applied at the upstream end of the cartridge has ruptured the opposed closure members 29' and 30', thereby permitting the charge 31 to be moved at 31' into the inlet end of the preheated pipe 12. The charge 31' therefore has assumed the configuration of a "pocket" of powdered plastic material which is forced through the pipe 12 in advance of a stream of air caused by the pressure differential placed across the pipe and the powder charging apparatus.

The individual powdered packages 27 may be gravitated into the opening 28, and after the pipe has been coated, the spent or empty cartridge can be manually extracted from the window 28. It is considered within the comprehension of this invention to provide the apparatus 114 with ejection apparatus by which the cartridge can be ejected automatically from the cylinder, such as seen illustrated in FIGS. 5–12, for example.

Figure 5:
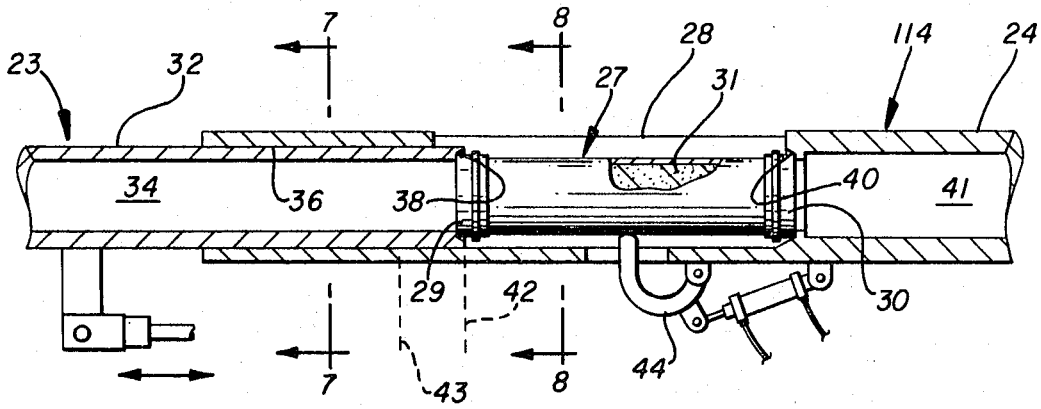
FIGS. 5 and 6 are fragmented, part cross-sectional views which illustrate the details of the apparatus disclosed in FIG. 2.

In FIG. 5, the ejector is seen to comprise a cylindrical, hollow member having an outer marginal end 32, an axial passageway 34, and an outer cylindrical surface which slidably engages cylindrical surface 36 of the chamber 24. The inner terminal end 38 of member 32 sealingly engages one end of the cartridge 27 while the other end of the cartridge sealingly engages surface 40 of chamber 24. Axial passageway 41 preferably is axially aligned with the cartridge 27 and with the axial passageway 34 of member 32.

Seal surface 38 is moved from the dot-dash position 42 into the dot-dash position 43 when piston 26 of cylinder 25 reciprocates the ejector.

Figure 6:
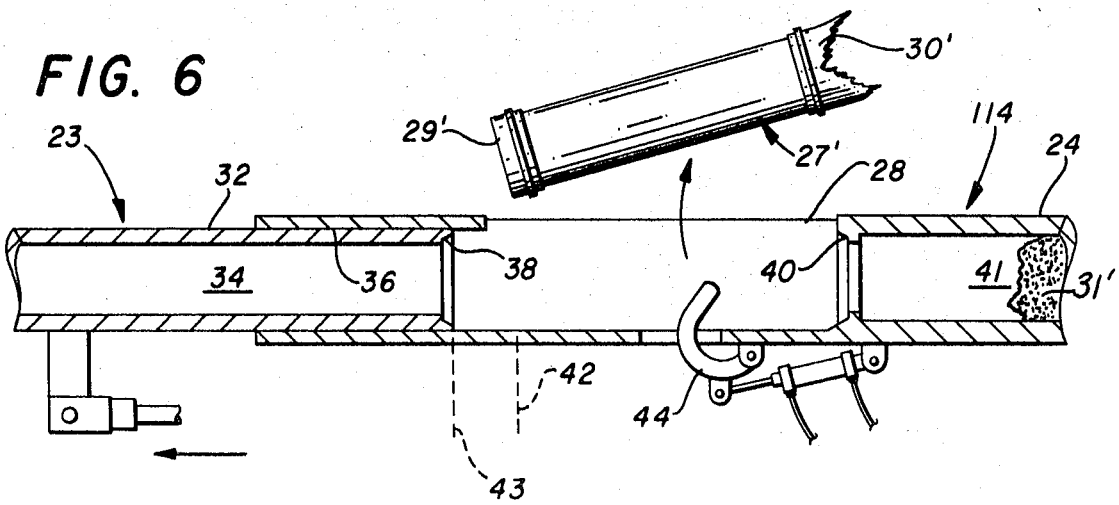
Figure 7:
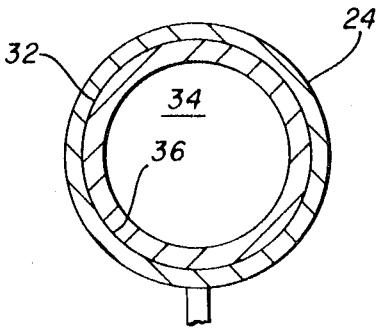
FIGS. 7 and 8, respectively, are cross-sectional views taken along lines 7—7 and 8—8, respectively, of FIG. 5.
Figure 8:
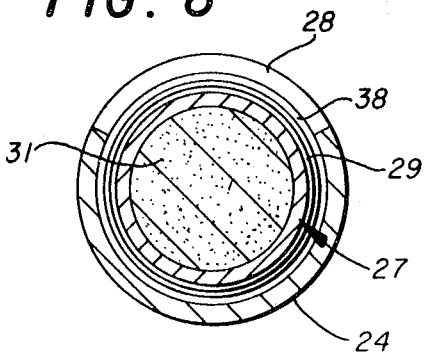

Apparatus 44 is manipulated by the illustrated air cylinder from a retracted to an extended position thereby pushing the spent cartridge back through the window of the chamber after member 32 has been reciprocated away from the cartridge, as illustrated in FIG. 6, which shows the apparatus of FIG. 5 in the unloaded configuration, wherein the plunger 23 has been reciprocated away from the cartridge chamber and the cartridge has been removed from the chamber.

Figure 9:
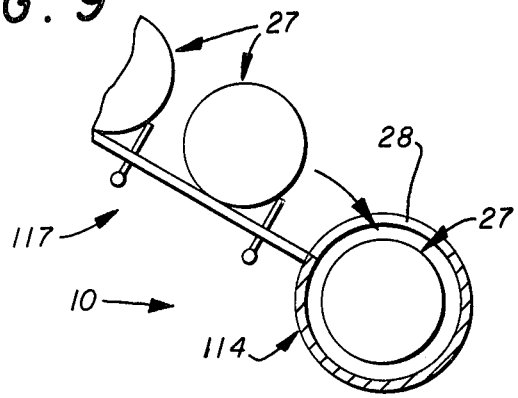
FIG. 9 is another cross-sectional view of the apparatus as disclosed in FIG. 8, showing the apparatus in an alternant configuration.

In FIG. 9, the individual cartridges are being sequentially metered into the cartridge holding chamber of the apparatus of FIG. 5.

Figure 10:
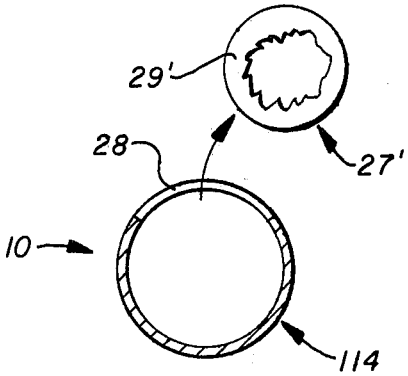
FIG. 10 is another cross-sectional view similar to FIG. 9, showing the apparatus in another alternant configuration.

In FIGS. 6 and 10, the spent cartridge 27' is in the act of being removed from the cartridge holding chamber. It will be noted that the closure members 29 and 30 have been ruptured, or opened, as indicated by numerals 29' and 30'.

Figure 11:
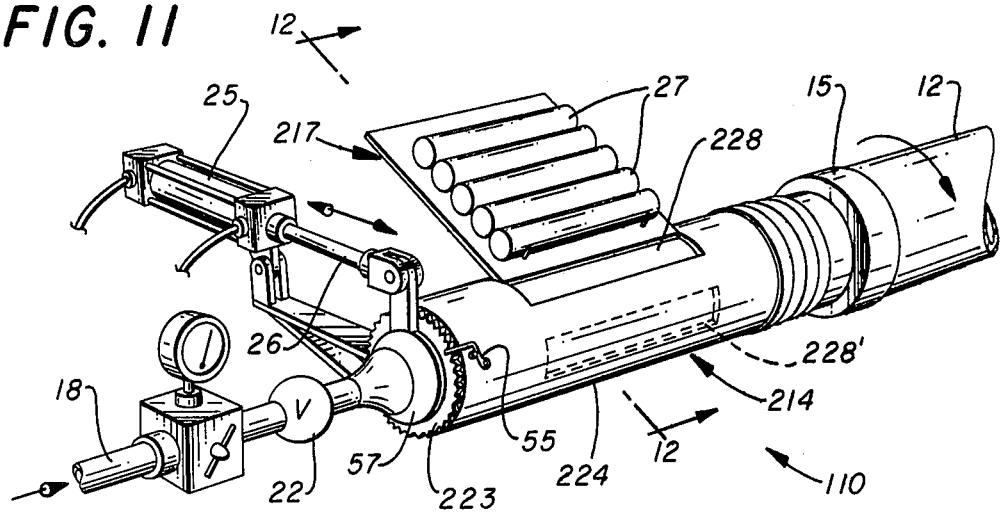
FIG. 11 is a fragmented, perspective view which sets forth another embodiment of the present invention.
Figure 12:
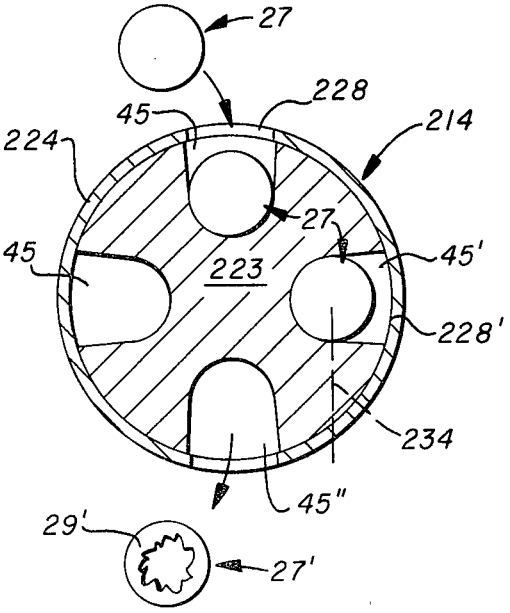
FIG. 12 is a cross-sectional view taken along line 12—12 of FIG. 11.

In FIGS. 11 and 12, a plurality of cartridges 27 are arranged in side-by-side relationship as indicated by numeral 217 so that each cartridge is sequentially fed into the window 228. Air cylinder 25 reciprocates piston 26 which in turn revolves the cylinder 223 an appropriate amount to move a cartridge 27 from position 217 into position 228, which is the powdered charging position when the cartridge is isolated so that flow of air at 22 provides a pressure differential across the cartridge, thereby opening the closure members 29 and 30 so that the powdered charge can form a pocket and flow through the preheated, rotating pipe a single pass while coating the pipe interior.

Hence, the apparatus of FIGS. 11 and 12 illustrate an apparatus which includes a cylinder 223 having a plurality of radially spaced apart chambers 45 which are indexed with an inlet window 228, a charging chamber 45, a shooting chamber 45', and a discharge window 45''.

Figures 13, 14:
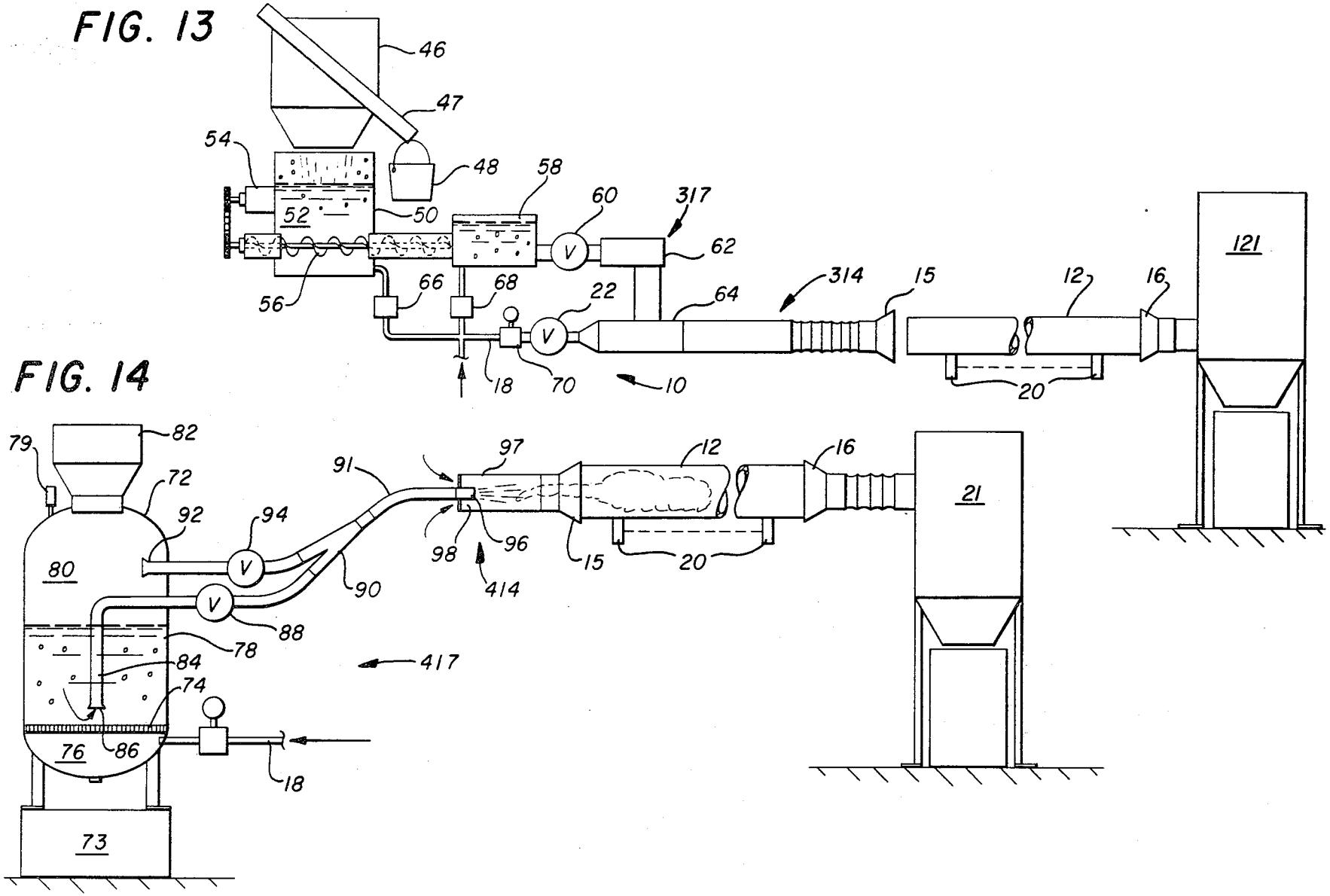
FIG. 13 is a diagrammatical illustration of still another embodiment of the present invention.
FIG. 14 is a side view which diagrammatically sets forth still another embodiment of the present invention; and, FIG. 15 is an enlarged, fragmented, detailed view of part of the apparatus disclosed in FIG. 14.

In the embodiment set forth in FIG. 13, there is disclosed a hopper 46 having a screen 47 incorporated therewithin for returning oversized plastic particles to container 48. Chamber 50 contains a fluidized bed 52 of powder plastic. Motor 54 drives auger 56 for moving fluidized plastic 52 into intermediate fluidized chamber 58. Valve 60 opens to admit flow of powder plastic into chamber 317, which includes means 62 for measuring each individual charge. From the scale means 62, an individual powder charge is placed within chambers 64. Regulators 66, 68, and 70 maintain the proper flow of air into chambers 50, 58, and to valve 22.

Opening of valve 22 forces the charge of powdered plastic to flow from chamber 64 into the rotating pipe 12. Apparatus 121 collects the residual plastic which is not fused onto the inner wall surface of the pipe.

As another embodiment of the invention, the apparatus 121 is a vacuum or supply of reduced pressure which is coupled at 16 to pipe 12 so that the pressure gradient across the pipe can be considerably increased as the pocket flows through the pipe.

Figure 15:
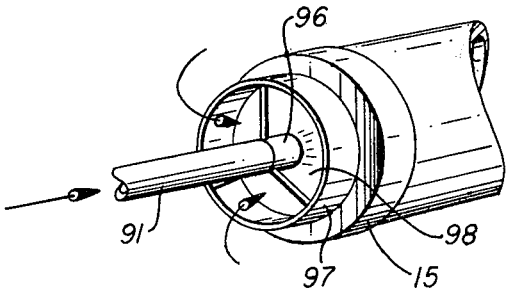

In the embodiment of the invention illustrated in FIG. 14, together with FIG. 15, the powder charging apparatus 414 comprises a powder vessel 72 arranged in proximity to a preheated rotating pipe 12. A source of air pressure is available from tank 73.

An air stone 74 separates air chamber 76 from fluidized bed 78 and permits a flow of air to occur into the bed. The fluidized bed is spaced from the top of the vessel to provide an air space 80. Pop-off valve 79 maintains the pressure at 80 at a value lower than the pressure at 76.

A charge hopper 82 is provided with suitable valve means by which powder can be charged into the vessel in order to replenish the bed 78 from time to time.

Powder conveying tube 84 has an inlet 86 submerged within the bed. Valve 88 connects the tube 84 to Y fitting 90. Tube 92 communicates air space 80 with the Y 90 by means of valve 94. Valves 88 and 94 are quick acting valves which can be selectively actuated, and remotely controlled.

Nozzle 96 is supported within cylinder 97, with there being an annulus 98 formed therebetween. The other end of the preheated, rotating pipe is connected to collector 21 for collecting the residual powdered plastic which emerges from the outlet end of the pipe.

As another embodiment of this invention, the collector 21 is a vacuum tank which is connected to the pipe at 16 for producing a pressure far below atmospheric pressure at the outlet end of the pipe, thereby providing a greater pressure differential from the inlet to the outlet of the pipe as the pocket of plastic flows therethrough.

OPERATION

FIG. 1 diagrammatically illustrates in a schematical manner, the overall operation of the method of the present invention. In FIG. 1, preheated pipes at 12' have been cleaned, primed, and are ready to be powdered coated with plastic. The individual joints of preheated pipe are transferred from preheater device 19, onto the support rollers 20, so that the individual joint of pipe 12 is rotated at a speed which causes any subsequently fused plastic to spread into a uniform coating on the interior wall surface of the pipe.

Powder charging apparatus 14 forms a discrete pocket of powdered plastic. Head 15 removably connects apparatus 14 to the inlet end of pipe 12. Outlet adaptor 16 removably connects the outlet end of the pipe to reclaiming apparatus 21 which gathers the residual powdered plastic. The apparatus 21 can be omitted as a separate embodiment of this invention.

A measured quantity of plastic is transferred from supply 17 into the powdered charging apparatus. Control valve 22 controls the flow of air from pressure source 18 into the powdered charging apparatus. The measured quantity of plastic is placed into the pocket forming apparatus 14, the valve opened, and the pocket of plastic pushed through the preheated, rotating pipe. A single pass of the pocket of plastic coats the pipe interior. The pipe is removed from the rollers 20 and another pipe 12' substituted therefor.

FIGS. 2–10 illustrate one specific embodiment of the invention for practicing the method set forth in FIG. 1. As particularly seen in FIG. 2, prepackaged containers of powdered plastic 27 are stored at 117 so that the individual packages are sequentially fed into the window 28 of the powdered charging appartus 114. The powder charging apparatus includes hollow cylindrical plunger 23, which is reciprocatingly received within chamber 24. The plunger is reciprocated by the air cylinder 25 and piston shaft 26 which moves the plunger axially respective to chamber 24.

As best seen illustrated in FIG. 5, together with FIGS. 2 and 6–10, the plunger 23 is extended by actuation of cylinder 25, thereby opening the charging aperture or window 28. After a powder pack 27 rolls through window 28 into the illustrated position seen in FIG. 5, the plunger is reciprocated to sealingly compress the powder pack in aligned relationship between seal surfaces 38 and 40. Valve 22 is next opened, whereupon high pressure air flows from 18, through passageway 34, causing the powder 31 within the powder pack to be forced into passageway 41, in the dynamic illustration of FIG. 4. The pocket is formed and is forced through the head 15, where the pocket of powdered plastic is forced through the rotating preheated pipe 12.

After the valve 22 is closed, cylinder 25 is actuated to extend the plunger, ejector 44 is actuated to remove the spent powder package in the manner of FIG. 6, whereupon another powder pack 27 can be loaded into the powder charging apparatus.

As seen in FIGS. 3 and 4, the powder packs 27 preferably are cylindrical in form, and are provided with a closure means at the opposed ends 29 and 30, which are opened when a sufficient pressure differential is imposed across the package, as illustrated in FIG. 4.

One example of the powder pack is a reinforced cardboard cylinder having a weighed or measured quantity of powdered plastic material placed therewithin, with a thin membrane, such as a sheet of plastic or paper being secured in place over the ends by a heavy rubber band. As seen in FIG. 4, the pressure differential across the package ruptures the opposed closure members, and forms a pocket of powdered plastic 31' which is pushed into the inlet end of pipe 12 where the pressure differential across the pipe moves the pocket through the preheated pipe. The length of the pocket is substantially less than the length of the pipe being coated. The pipe usually is 28–36 feet in length.

In the embodiment 110 set forth in the illustration of FIGS. 11 and 12, a cylinder 223 is provided with radially spaced apart chambers 45 of a length and diameter to receive a powder pack 27 therewithin. The cylinder rotates about its axial centerline within chamber 224. As the pison 26 reciprocates, the clutch means 57 is actuated, and the rack and pawl at 55 permits the cylinder 223 to advance in a clockwise direction. The clutch slips as the piston pulls the clutch means in a counterclockwise direction.

This action advances the cylinder one chamber each time the cylinder 25 is actuated one cycle of operation, so that a powder pack 27 placed through window 228 into chamber 45 is advanced into the coating position at 45', and a spent powder pack at position 45' is advanced into the discharge positiion 45''. The spent cartridge drops from the chamber as noted by numeral 27'.

Accordingly, after a cartridge has been advanced to position 45', valve 22 is opened so that flow of air pushes the powder from the powder pack chamber 45', thereby forming a powder pocket which flows into the inlet end of the pipe in the before described manner.

In the illustrated embodiment set forth in FIG. 13, powdered plastic is charged into hopper 46, where the powder is sifted by screen 47 and flows into the fluidized bed 52. Motor 54 is energized, causing fluidized plastic to be transferred into the holding chamber 58, which also is fluidized. Valve 60 is opened to cause powdered plastic to accumulate within weighing station 317 until the appropriate measured amount of powdered plastic has accumulated, whereupon the measured quantity of plastic is transferred into the coating chamber 64. The charge is isolated within chamber 64. Valve 22 is opened, thereby blowing the entire contents of chamber 64 through the head 15 and into the pipe 12 in the before described manner of FIGS. 2 and 5.

In the embodiment of the invention set forth in FIGS. 14 and 15, valve 88 is opened for a length of time proportional to the quantity of desired powdered plastic which is charged into conduit 91. Valve 94 is opened simultaneously with the closure of valve 88 so that the pocket of powdered plastic is pushed into the nozzle support at 96, into the pipe inlet at 15, where the pocket moves through the pipe in the before described manner, thereby coating the interior of the pipe with the fused powdered plastic polymer.

The area of the annulus at 98 is adjusted to control the ambient air-entrained into the system, which controls the density of the powder pocket, and the volume of air which pushes the pocket through the pipe.

I claim:

1. Method of powder coating the interior of a tubular element with a synthetic plastic resin material comprising the steps of:

(1) preheating the element to a temperature in excess of the fusion temperature of a synthetic plastic resin powder;

(2) rotating the preheated element about its longitudinal axis at a speed which enables any subsequently fused plastic resin material to spread into a continuous film;

(3) measuring powdered synthetic resin material to provide a single charge of powdered material which is sufficient for coating the entire interior surface of the preheated element;

(4) placing the single charge into a container which has an inlet opposed to an outlet; closing said inlet and said outlet with a closing member;

(5) placing said container within an enclosure, communicating said enclosure with one end of the preheated element by connecting a flow conduit to said enclosure at a location downstream of said charge and connecting the other end of said flow conduit to one end of the preheated rotating element;

(6) connecting a supply of compressed air to said enclosure at a location upstream of said container;

(7) flowing compressed air from said supply, into said enclosure, and into said inlet of said container, thereby placing a pressure differential across the container;

(8) opening said inlet and said outlet by using the pressure differential across the container to cause the closure members at the container inlet and outlet to be moved to an opened position, whereupon flow of compressed air occurs through said container, and the single charge is formed into a pocket which moves in advance of the air flowing from the supply;

(9) flowing the compressed air from said supply, through said enclosure, and through said element at a rate which moves the entire charge from the container located within said enclosure in advance of the flowing air to push the charge into said rotating preheated element as a pocket of powder, so that the powder contained within the pocket contacts the interior wall surface of the rotating preheated element and is fused into a coating in a single pass of the pocket through the element; and,

(10) cooling the coated element to a temperature below the fusion temperature of the plastic.

2. Method of powder coating the interior of a tubular element with a synthetic plastic resin material comprising the steps of:

(1) preheating the element to a temperature in excess of the fusion temperature of a synthetic plastic resin powder;

(2) rotating the preheated element about its longitudinal axis at a speed which enables any subsequently fused plastic resin to spread into a continuous film;

(3) measuring powdered synthetic resin material to provide a single charge of powdered material which is sufficient for coating the entire interior surface of said element;

(4) storing said charge of powdered material within a package of a size to be received within an enclosure, communicating said enclosure with one end of said element by connecting a flow conduit to said enclosure at a location downstream of said package and connecting the other end of said flow conduit to one end of the preheated rotating element;

(5) connecting a supply of air to said enclosure at a location upstream of said package;

(6) making a lateral charge receiving entrance into said enclosure;

(7) moving said package through said entrance and into said enclosure;

(8) flowing air from said supply, into said enclosure, through said package, to the inlet end of said element, and through said element at a rate which produces a pressure differential across the package of a magnitude which moves the entire charge from the package contained within said enclosure and thereafter causes the entire charge to move in advance of said flowing air to push the charge into said element as a pocket of powder, so that the powder contained within the pocket contacts the interior wall surface of said element and is melted into a coating in a single pass of the pocket through the element; and, (9) cooling the coated element to a temperature below the fusion temperature of the plastic.

3. The method of claim 2 and further including the steps of:

radially spacing a plurality of said packages apart from one another, successively moving the packages into axially aligned relationship respective to said enclosure;

sequentially moving a heated tubular element into communication with the outlet end of said flow conduit as each package is moved into said enclosure.

4. Method of powder coating the interior of tubular elements with a synthetic plastic resin material comprising the steps of:

(1) preheating the elements to a temperature in excess of the fusion temperature of a synthetic plastic resin powder;

(2) successively rotating the preheated elements about its longitudinal axis at a speed which enables any subsequently fused plastic resin to spread into a continuous film;

(3) measuring powdered synthetic resin material to provide a plurality of single charges of powdered material, each of which is sufficient for coating the entire interior surface of one of said elements;

(4) storing each said charge of powdered material within a container means and successively moving the container means into an enclosure, communicating said enclosure with one end of said element by connecting a flow conduit to said enclosure at a location downstream of said container means and connecting the other end of said flow conduit to one end of the preheated rotating element;

(5) connecting a supply of air to said enclosure at a location upstream of said container means, and forcing air to flow through said enclosure, thereby placing a pressure differential across the container;

(6) using the pressure differential across the container for causing a single charge to flow from said container means into said flow conduit;

(7) flowing air from said supply, through said enclosure, and through said element at a rate which moves the entire charge from said container means and from said enclosure in advance of said flowing air to push the charge into said rotating element as a pocket of powder, so that the powder contained within the pocket contacts the interior wall surface of said element and is melted into a coating in a single pass of the pocket through the element; and, (8) cooling the coated element to a temperature below the fusion temperature of the plastic.

5. Method of powder coating the interior of a pipe with a synthetic plastic powder material comprising the steps of:

(1) preheating the pipe to be coated to a temperature in excess of the fusion temperature of a powdered plastic material;

(2) rotating said preheated pipe about its longitudinal axis at a velocity which causes any subsequently fused plastic powder to spread out into a continuous film;

(3) communicating an inlet end of the rotating pipe with one end of a flow conduit, while the other end of the pipe is left unrestricted respective to flow therethrough;

(4) placing a single charge of plastic powder into a container which has an inlet opposed to an outlet; said charge being in excess of the amount required to coat the interior of the pipe; placing a closure means at said container inlet and outlet for isolating the charge therewithin;

(5) placing the container of step (4) upstream of the pipe inlet and within the flow conduit;

(6) applying pneumatic pressure to the flow conduit at a location upstream of said container to effect a pressure differential across the container; and, using the pressure differential to open the container closure means, so that the charge assumes the form of a pocket of powdered plastic material as the charge flows towards the pipe inlet; and, (7) pushing the entire pocket from the flow conduit and into the preheated, rotating pipe; and, limiting the length of the pocket to a value less than the length of the pipe; whereupon particles of powdered plastic progressively deposit onto the heated, inside surface of the pipe and fuse thereto as the pocket moves into the pipe inlet, through the pipe, and out the other end of the pipe.

6. The method of claim 5 and further including the steps of:

radially spacing a plurality of said containers apart from one another, successively moving the container into axially aligned relationship respective to said enclosure and said flow conduit;

sequentially moving a preheated element into communication with said outlet as each container is moved into said axially aligned relationship.

7. The method of claim 5 and further including the steps of:

making a lateral charge receiving entrance into said enclosure;

moving said container laterally through said entrance and into said enclosure;

carrying out steps (6) and (7) and thereafter removing said container from said enclosure.

8. Method of powder coating the interior of a tubular element with heat fusable material comprising the steps of:

(1) selecting a powdered synthetic plastic material in particulate form which is capable of being bonded to the inside wall surface of the tubular element;

(2) preheating the tubular element to a temperature in excess of the fusion temperature of the plastic material;

(3) rotating the preheated tubular element about its longitudinal axis at a speed which enables any subsequently fused plastic material to spread into a continuous film;

(4) measuring a quantity of said plastic material to provide a powder charge; and isolating the charge within a container by placing closure means on said container; said charge being slightly in excess of the amount of plastic material required to uniformly coat the entire interior of said tubular element;

(5) placing an outlet in communication with said container at a location downstream of said charge, and placing an inlet in communication with said container at a location upstream of said charge; and communicating one end of the rotating, preheated tubular element with the outlet of said container, while leaving the other end of the tubular element unobstructed to flow therethrough;

(6) applying a positive air pressure at the inlet of said container respective to atmospheric pressure to effect a pressure differential across said container and using the pressure differential for opening said closure means;

(7) forcing the entire isolated charge of step (4) into the interior of said tubular element by continuing the application of the positive air pressure at the inlet end so that flow occurs into the inlet of said container, through said outlet end, and through said tubular element, thereby forming a pocket which moves only one time through the tubular element in advance of a stream of compressible fluid so that the interior of said element is coated with the plastic material in a single pass;

(8) said pocket, as it flows through the interior of said element is confined to a length which is less than the length of said tubular element.

9. The method of claim 8 and further includng the steps of:

carrying out step (5) by receiving said container within an enclosure; making an entrance into a sidewall of said enclosure; and, moving said container through said entrance and into said enclosure, and thereafter carrying out steps (5)-(7); and thereafter; removing said container from said enclosure.

10. Method of powder coating the interior of a tubular element with heat fusable material comprising the steps of:

(1) selecting a synthetic plastic material in particulate form which is capable of being bonded to the inside wall surface of the tubular element;

(2) preheating the tubular element to a temperature in excess of the fusion temperature of the plastic material;

(3) rotating the preheated tubular element about its longitudinal axis at a speed which enables any subsequently fused plastic material to spread into a continuous film;

(4) measuring a quantity of said plastic material to provide a powder charge; and isolating the charge within a container; said charge being slightly in excess of the amount of plastic material required to uniformly coat the entire interior of said tubular element;

(5) providing an inlet and outlet for said container, closing said inlet and outlet by placing a pressure responsive closure means on said container inlet and outlet;

(6) placing said outlet of said container downstream of said charge, and placing said inlet of said container upstream of said charge; and communicating one end of the rotating, preheated tubular element with the outlet of said container, while leaving the other end of the tubular element unobstructed to flow therethrough;

(7) applying a positive pressure which is above atmospheric pressure at the inlet end of said container, said positive pressure being of sufficient magnitude to cause said pressure responsive closure means on said container inlet and outlet to assume an open configuration so that said isolated charge can be forced to flow from said container;

(8) continuing to apply the positive pressure of step (7) so that flow occurs into the inlet of said container, through said outlet, and through said tubular element, thereby forming a pocket which moves only one time through the tubular element in advance of a stream of compressible fluid so that the interior of said element is coated with the plastic material in a single pass;

(9) said pocket, as it flows through the interior of said element is confined to a length which is less than the length of said tubular element.

11. Method of powder coating the interior of a tubular element with heat fusable material comprising the steps of:

(1) selecting a synthetic plastic material in particulate form which is capable of being bonded to the inside wall surface of the tubular element;

(2) preheating the tubular element to a temperature in excess of the fusion temperature of the plastic material;

(3) rotating the preheated tubular element about its longitudinal axis at a speed which enables any subsequently fused plastic material to spread into a continuous film;

(4) measuring a quantity of said plastic material to provide a powder charge; and isolating the charge within a container; said charge being slightly in excess of the amount of plastic material required to uniformly coat the entire interior of said tubular element;

(5) providing an inlet and outlet for said container, preventing flow through said inlet and outlet by placing a pressure responsive closure means on said container inlet and outlet;

(6) placing said outlet of said container downstream of said charge, and placing said inlet of said container upstream of said charge; and communicating one end of the rotating, preheated tubular element with the outlet of said container, while leaving the other end of the tubular element unobstructed to flow therethrough;

(7) applying a pressure at the inlet end of said container to thereby effect a pressure differential across said container; said pressure differential being of sufficient magnitude to cause said pressure responsive closure means on said container inlet and outlet to assume an open configuration so that said isolated charge is forced to flow from said container;

(8) forcing the entire isolated charge of step (4) into the interior of said tubular element by continuing to apply the pressure of step (7) at said inlet so that flow occurs into the inlet of said container, through said outlet, and through said tubular element, thereby forming a pocket which moves only one time through the tubular element in advance of a stream of compressible fluid so that the interior of said element is coated with the plastic material in a single pass therethrough;

(9) said pocket, as it flows through the interior of said element is confined to a length which is less than the length of said tubular element.

12. The method of claim 11 and further including the steps of:

providing a plurality of containers as set forth in step (4); successively moving the containers into aligned relationship respective to the flow of air to the tubular element;

sequentially moving a preheated element into communication with said outlet as each container is moved into said aligned relationship.

13. Method of powder coating the interior of a tubular element with heat fusable material comprising the steps of:

(1) selecting a powdered synthetic plastic material in particulate form which is capable of being bonded to the inside wall surface of the tubular element;

(2) preheating the tubular element to a temperature in excess of the fusion temperature of the plastic material;

(3) rotating the preheated tubular element about its longitudinal axis at a speed which enables any subsequently fused plastic material to spread into a continuous film;

(4) measuring a quantity of said plastic material to provide a powder charge; and isolating the powder charge within container by placing closure means on said container; said charge being slightly in excess of the amount of plastic material required to uniformly coat the entire interior of said tubular element;

(5) placing an outlet means in communication with said container at a location downstream of said charge, and placing an inlet in communication with said container at a location upstream of said charge; and communicating one end of the rotating, preheated tubular element with said outlet while leaving the other end of the tubular element unobstructed to flow therethrough;

(6) effecting a pressure differential across said container by forcing a compressible fluid to flow from said inlet towards said outlet; and using the pressure differential for opening said closure means;

(7) forcing the entire isolated charge of step (4) into the interior of said tubular element by continuing the flow of compressible fluid so that flow occurs into said container, through said outlet end, and through said tubular element, thereby forming a pocket which moves only one time through the tubular element in advance of a stream of compressible fluid so that the interior of said element is coated with the plastic material in a single pass;

(8) said pocket, as it flows through the interior of said element is confined to a length which is less than the length of said tubular element.

* * * * *

UNITED STATES PATENT AND TRADEMARK OFFICE

CERTIFICATE OF CORRECTION

PATENT NO. : 4,420,508

DATED : December 13, 1983

INVENTOR(S) : JACK E. GIBSON

It is certified that error appears in the above—identified patent and that said Letters Patent is hereby corrected as shown below:

Column 1, line 63, substitute --a-- for "s";

Column 4, line 30, insert --a-- before "plunger";

Claim 13, line 16, insert --a-- before "container".

Signed and Sealed this

*Seventeenth* Day of *April 1984*

[SEAL]

*Attest:*

GERALD J. MOSSINGHOFF

*Attesting Officer*

*Commissioner of Patents and Trademarks*